US005150555A

United States Patent [19]

Wood

[11] Patent Number: 5,150,555

[45] Date of Patent: Sep. 29, 1992

[54] SIDING CLIP

[76] Inventor: Larry A. Wood, 9000 Kolbrook Rd., Denton, Nebr. 68339

[21] Appl. No.: 729,033

[22] Filed: Jul. 12, 1991

[51] Int. Cl.[5] ..... E04D 1/34

[52] U.S. Cl. ..... 52/544

[58] Field of Search ..... 52/520, 521, 531, 543, 52/544, 518, 519, 489

[56] References Cited

U.S. PATENT DOCUMENTS

| | | | |
|---|---|---|---|
| 2,293,744 | 8/1942 | Miles et al. | 52/543 |
| 3,233,382 | 2/1966 | Graveley, Jr. | 52/522 |
| 3,504,467 | 4/1970 | Hatch, Jr. | 52/309 |
| 3,520,099 | 7/1970 | Mattes | 52/531 |
| 3,757,483 | 9/1973 | Torbett | 52/535 |
| 3,999,348 | 12/1976 | Hicks | 52/544 |
| 4,186,538 | 2/1980 | Marcum, Jr. | 52/521 |
| 4,327,528 | 5/1982 | Fritz | 52/309.1 |
| 4,348,849 | 9/1982 | Wollam et al. | 52/557 |
| 4,435,933 | 3/1984 | Krowl | 52/309.1 |
| 4,646,501 | 3/1987 | Champagne et al. | 52/520 |

*Primary Examiner*—James L. Ridgill, Jr.
*Attorney, Agent, or Firm*—Zarley, McKee, Thomte, Voorhees & Sease

[57] ABSTRACT

A siding clip is formed from a planar sheet folded to create forward and rearward legs connected along a horizontal upper fold, with the forward leg being bent forwardly and then downwardly to form a downwardly opening longitudinal slot with respect to the rearward leg. The rearward leg depends downwardly beyond the lower end of the forward leg, and is then bent forwardly and downwardly so as to be received within a longitudinal slot in a siding panel. A fastener may be affixed through an aperture in the forward and rearward legs so as to connect the siding clip to a wall.

9 Claims, 2 Drawing Sheets

SIDING CLIP

TECHNICAL FIELD

The present invention relates generally to the attachment of vinyl siding to a building, and more particularly to an improved clip for attaching the siding to the building while permitting horizontal movement of the siding due to expansion and contraction of the siding with changes in temperature.

Background of the Invention

Wood siding has been used for many years in the construction of homes and other buildings. However, wood siding has several disadvantages, including regular painting for protection, and eventual rot or other breakdown of the wood material.

In order to retain the visual effect of siding, yet overcome the problems associated with wood, alternative materials such as metal and plastics have been utilized to simulate wood siding. Metal siding is typically formed of aluminum or steel, while plastic siding is conventionally formed from polyvinyl chloride, more commonly referred to as vinyl. In both types of siding, the bottom margin of each panel is bent inwardly and then upwardly to form a longitudinal channel flange with an upstanding inner leg, and the top portion of each panel is formed to provide an outwardly and downwardly projecting longitudinal lip corresponding to the channel flange of an adjacent panel. The panels are conventionally secured to a wall along their top portions, above the projecting longitudinal lip, utilizing fasteners driven through a nailing flange along the top of each panel.

One problem that is common with both metal and vinyl siding is in the expansion and contraction of the siding with changes in temperature. Because of this expansion and contraction, it has been common to attach the siding utilizing longitudinal nail slots provided in the nailing flange of each panel. The nails were then intended to be driven into the nail slots a sufficient distance to support the siding, but not far enough to grip the siding to prevent slidable movement along the nail slots.

The main difficulty with such nail slots is that it is difficult to drive a fastener through the nail slot without fastening the nail too tight, thereby preventing slidable movement. This is especially true when the fasteners are applied utilizing power tools.

It is therefore a general object of the present invention to provide an improved clip which will support a siding panel yet permit freely slidable longitudinal movement of the panel on the clip.

Another object of the present invention is to provide a siding clip which permits freedom of the siding to expand and contract without hindrance by the clip.

Still another object is to provide a siding clip which will not bind in the panel during expansion or contraction of the siding panel.

These and other objects will be understood when considered in relation to the preferred embodiment, as set forth in the specification and shown in the drawings.

SUMMARY OF THE INVENTION

The siding clip of the present invention is designed to support a conventional elongated side panel of the type having upper and lower edges which are interconnectable with other siding panels. The siding panel includes a forwardly and downwardly projecting longitudinal width which forms a downwardly opening channel for receiving the lower edge of another siding panel. An upwardly opening longitudinal slot is formed in the rearward surface of the longitudinal lip so as to receive the lower end of a rearward leg of the siding clip. The siding panel includes an upwardly projecting nailing flange which is slidably connected within a downwardly opening vertical slot in the siding clip. The siding clip includes forward and rearward legs connected along a horizontal upper fold, with the forward leg being bent forwardly and then downwardly to form a downwardly opening longitudinal slot with respect to the rearward leg. The rearward leg depends downwardly beyond the lower end of the forward leg, and is then bent forwardly and downwardly so as to be received within the longitudinal slot in the siding panel. A fastener may be affixed through an aperture in the forward and rearward legs so as to connect the siding clip to a wall.

DESCRIPTION OF THE PREFERRED EMBODIMENT

Figure 1:
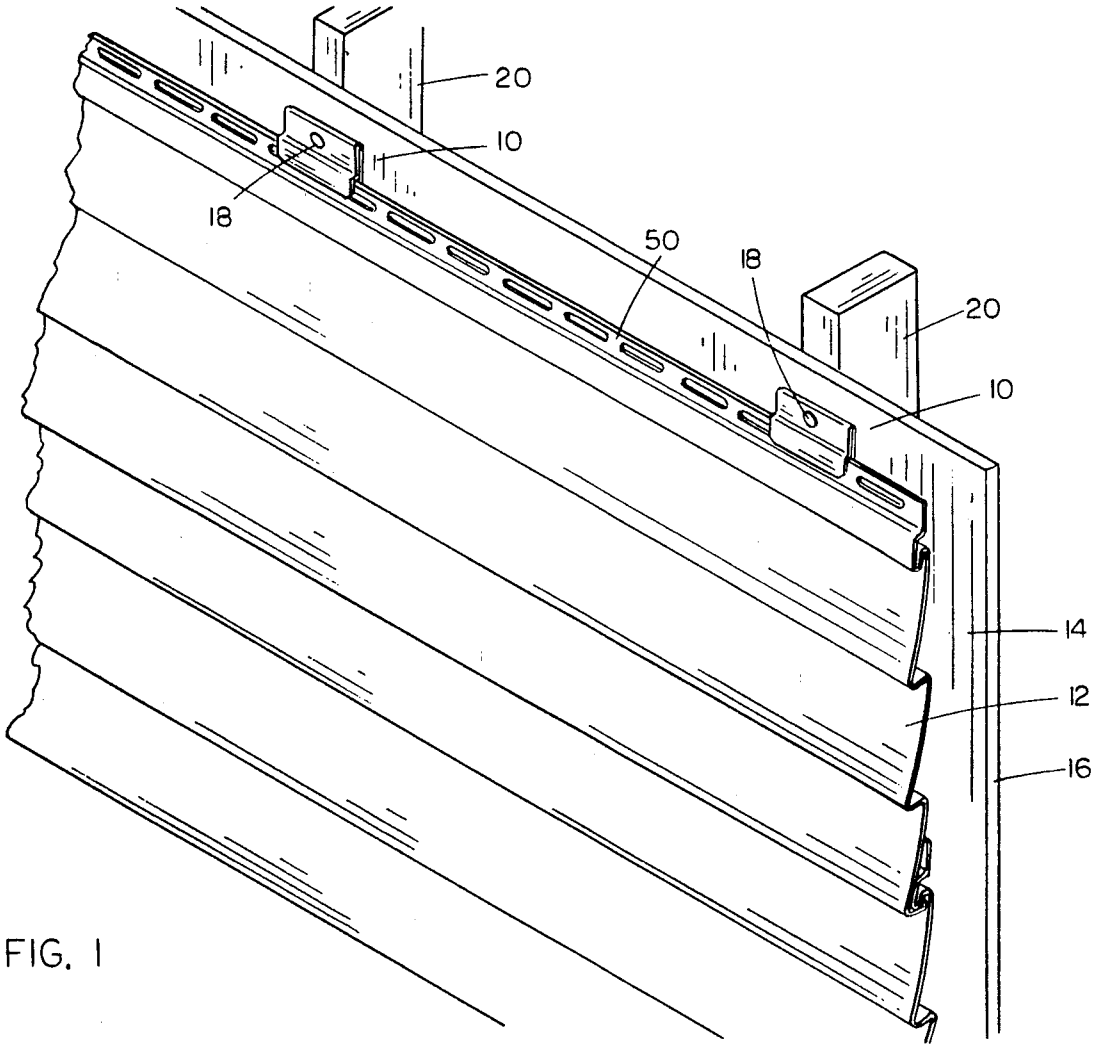
FIG. 1 is a perspective view of a wall with siding attached thereto utilizing clips of the present invention.

Referring now to the drawings, in which similar or corresponding parts are identified with the same reference and numeral, in more particularly to FIG. the siding clip of the present invention is identified generally at 10 and is shown retaining a siding panel 12 in position on the front surface 14 of a wall 16. Preferably, each siding clip 10 is mounted with a nail 18, or other fastener directly into a wall stud 20.

Figure 2:
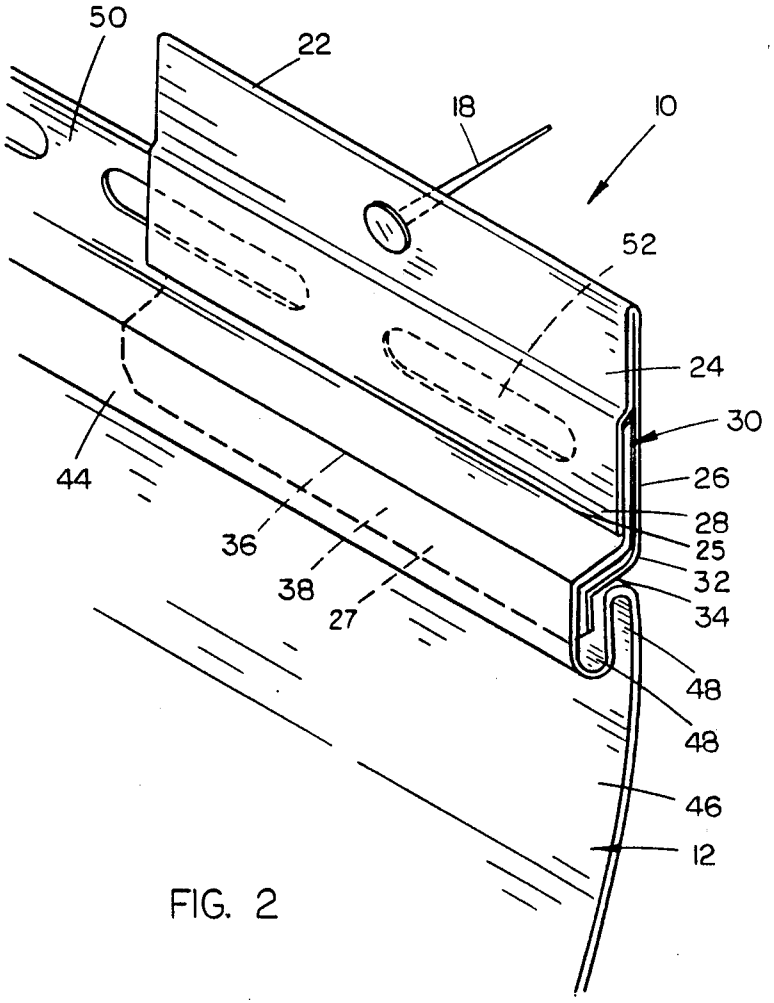
FIG. 2 is an enlarged view of a clip of the present invention with siding shown connected thereto in broken lines.

Referring now to FIG. 2, siding clip 10 is formed from a thin rectangular sheet of metal which is folded so as to form an upper horizontal edge 22 at the bend, with a forward leg 24 and a rearward leg 26 depending from upper edge 22. Forward leg 24 has the lower half thereof bent forwardly and thence downwardly parallel to rearward leg 26 to form a downwardly open vertical slot 30.

Rearward leg 26 depends downwardly past forward leg 24, and is bent forwardly at bend 32 slightly below the lower edge of forward leg lower half 28 to form a sloped shelf 34 which projects forwardly beyond forward leg lower half 28. Lower leg 26 is then bent downwardly at bend 36, parallel to forward leg 24 to form a depending flange 38.

Figure 3:
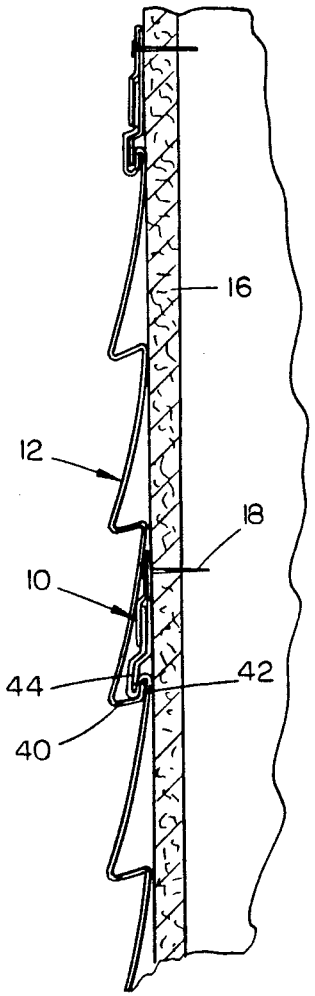
FIG. 3 is a vertical sectional view through the wall and siding of FIG. 1.

The bottom edge of each siding panel 12 is bent rearwardly and then upwardly to form an upwardly opening longitudinal channel 40 with an upstanding rearward leg 42, as shown in FIG. 3. The upper portion of siding panel 12 is shaped to provide a forwardly and downwardly projecting longitudinal lip 44, which projects forwardly away from the main body 46 of panel 12 to form a downwardly opening channel 48, as shown in FIG. 2. Lip 44 is formed by a fold in the siding panel 12, so as to form an upwardly opening longitudinal slot 49 which will receive a portion of clip 10, as described below. A nailing flange 50 projects upwardly to form the upper edge of siding panel 12, and has a plurality of horizontal slots 52 therein which are designed to receive a nail or other fastener.

In use, a siding panel 12 is attached to a wall 14 by slidably attaching a number of siding clips 10 to the upper edge thereof. Each siding clip 10 will slide onto the siding panel 12 with nailing flange 50 inserted within vertical slot 30, and depending flange 38 of clip 10 inserted within depending lip 44 of siding panel 12. As shown in FIGS. 2 and 3, siding panel 12 is slidably supported on sloped shelf 34 of clips 10, such that siding panel 12 may be moved longitudinally upon expansion and contraction due to changes in temperature. The longitudinal width of clip 10 is approximately four to five times the vertical height of the lower half of front leg 24, or vertical slot 30. This width is necessary in order to prevent the clip from rotating about nail 18 of the upper half of leg 24 upon longitudinal movement of the siding panel. Pivotal movement about nail 18 is detrimental since it will cause binding of the siding panel within clip 10, thereby causing warping of the siding panel.

The formation of a vertical slot 30 just above the formation of the depending flange 38 forms an arrangement which prevents the siding panel 12 from being released by vertical downward force on the siding panel 12.

Whereas the invention has been shown and described in connection with the preferred embodiment thereof, it will be understood that many modifications, substitutions and additions may be made which are within the intended broad scope of the appended claims. There has therefore been shown and described an improved siding clip which accomplishes at least all of the above stated objects.

I claim:

1. A siding clip, comprising:

a generally vertically planar sheet of rigid material folded upon itself to form a generally horizontal upper folded edge with depending forward and rearward legs having lower free ends and upper ends connected together to form said upper folded edge;

said forward leg extending downwardly parallel and adjacent to the rearward leg;

said forward leg being bent forwardly intermediate its upper and lower ends and thence downwardly parallel to the rearward leg, to form a downwardly opening vertical slot between said forward and reward legs;

said rearward leg being bent forwardly at a first horizontal bend below the lower end of said forward leg; and the lower end of side rearward leg being bent downwardly at a second horizontal bend, so as to be oriented generally parallel to said forward leg.

2. The siding clip of claim 1, wherein said lower end of the rearward leg projects forwardly beyond said forward leg such that the rearward leg lower end is parallel to and forward of the forward leg.

3. The siding clip of claim 1, wherein the forwardly bent portion of said rearward leg is bent both forwardly and downwardly to form a sloped surface.

4. The siding clip of claim 1, wherein said first horizontal bend is arcuate.

5. The siding clip of claim 1, further comprising means connected to said clip for attaching the clip to a wall.

6. The siding clip of claim 5, wherein said means for attaching the clip to a wall includes an aperture formed in said forward leg above said bent portion, a second aperture formed in said rearward leg coaxial with the first aperture, and fastener means inserted through said apertures and into a wall.

7. The siding clip of claim 1, wherein the width of said clip, as measured along said upper folded edge, is greater than the height of the clip, as measured from said upper folded edge to the lower end of said forward leg.

8. The siding clip of claim 7, wherein the width of the clip is at least twice the height of the clip.

9. In combination:

a horizontally elongated siding panel having upper and lower longitudinal edges, and having forward and rearward surfaces;

the bottom edge of said panel being bent rearwardly and then upwardly to form an upwardly opening longitudinal channel;

a forwardly and downwardly projecting longitudinal lip projecting forwardly away from the forward surface of said panel and below the upper edge, to form a downwardly opening channel;

an upwardly opening longitudinal slot formed in the rearward surface of said lip; and a nailing flange projecting upwardly to form the upper edge of said panel; and a siding clip slidably connected to said siding panel to permit longitudinal slidable movement of the panel while being vertically supported by the clip, comprising: a generally vertical planar sheet of rigid material folded upon itself to form a generally horizontal upper folded edge with depending forward and rearward legs having lower free ends and upper ends connected together at said folded edge;

said forward leg extending downwardly parallel and adjacent to the rearward leg;

said forward leg being bent forwardly intermediate its upper and lower ends and thence downwardly parallel to the rearward leg to form a downwardly opening vertical slot between said forward and rearward legs into which said nailing flange is longitudinally slidably received;

said rearward leg being bent forwardly at a first horizontal bend below the lower end of said forward leg; and the lower end of said leg being bent downwardly at a second horizontal bend, so as to be generally parallel to said forward leg and longitudinally slidably inserted within the upwardly opening longitudinal slot formed in the rearward surface in said siding panel lip.

* * * * *